US011773677B2

(12) United States Patent
Al-Obaidi et al.

(10) Patent No.: US 11,773,677 B2
(45) Date of Patent: Oct. 3, 2023

(54) ACID-INTEGRATED DRILL PIPE BARS TO RELEASE STUCK PIPE

(71) Applicant: Saudi Arabian Oil Company, Dhahran (SA)

(72) Inventors: Ibrahim A. Al-Obaidi, Khobar (SA); Nawaf D. Otaibi, Khobar (SA); Fahad A. Alenezi, Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/543,233

(22) Filed: Dec. 6, 2021

(65) Prior Publication Data

US 2023/0175336 A1 Jun. 8, 2023

(51) Int. Cl.
*E21B 31/03* (2006.01)
*E21B 34/14* (2006.01)

(52) U.S. Cl.
CPC ..... *E21B 31/03* (2013.01); *E21B 34/142* (2020.05)

(58) Field of Classification Search
CPC ..... E21B 31/03; E21B 34/142
See application file for complete search history.

(56) References Cited

U.S. PATENT DOCUMENTS

| | | | |
|---|---|---|---|
| 1,054,232 | A | 2/1913 | Mills |
| 1,455,314 | A | 5/1923 | Watkins |
| 1,617,303 | A | 2/1927 | Dougherty |
| 1,621,947 | A | 3/1927 | Moore |
| 1,645,010 | A | 10/1927 | Kinley |
| 1,652,472 | A | 12/1927 | Erwin |
| 1,678,829 | A | 7/1928 | Scott et al. |
| 1,749,380 | A | 3/1930 | Hinderliter |
| 1,794,562 | A | 3/1931 | Taylor |

(Continued)

FOREIGN PATENT DOCUMENTS

| | | |
|---|---|---|
| CA | 1205823 | 6/1986 |
| CA | 2664521 | 4/2007 |

(Continued)

OTHER PUBLICATIONS

U.S. Appl. No. 17/543,233, Al-Obaidi et al., filed Dec. 6, 2021.

(Continued)

*Primary Examiner* — Robert E Fuller
*Assistant Examiner* — Neel Girish Patel
(74) *Attorney, Agent, or Firm* — Fish & Richardson P.C.

(57) ABSTRACT

A wellbore tool assembly to release stuck pipe includes a tubular that includes an outer wall, an inner wall and an annular compartment defined between the outer wall and the inner wall. A quantity of acid is carried within the annular compartment of the tubular. Multiple ports are formed in the tubular. Each port fluidically connects an inner volume of the tubular with a volume outside the tubular through the annular compartment. The assembly includes a ball seat disposed within the tubular. The ball seat is configured to receive a ball dropped into the tubular. The multiple ports are configured to switch between an open position and a closed position. When in the open position, the multiple ports permit flow of the acid from the annular compartment to the formation. When in the closed position, the multiple ports prevent fluid flow from the annular compartment to the formation.

11 Claims, 5 Drawing Sheets

(56) References Cited

U.S. PATENT DOCUMENTS

| | | | | |
|---|---|---|---|---|
| 2,011,036 | A | 8/1935 | Colmerauer | |
| 2,078,426 | A | 4/1937 | Sweet | |
| 2,956,626 | A | 10/1960 | Hall | |
| 3,029,038 | A | 4/1962 | Lotz | |
| 3,036,855 | A | 5/1962 | Siracusa | |
| 3,096,822 | A | 7/1963 | Hall | |
| 3,129,759 | A | 4/1964 | Tillman | |
| 3,194,310 | A | 7/1965 | Doyle | |
| 3,199,598 | A | 8/1965 | Doyle | |
| 3,242,985 | A | 3/1966 | North | |
| 3,323,360 | A | 6/1967 | Nutter | |
| 3,424,244 | A | 1/1969 | Kinley | |
| 3,795,035 | A | 3/1974 | Pogonowski | |
| 3,800,871 | A | 4/1974 | Watson | |
| 4,046,405 | A | 9/1977 | Bonds | |
| 4,585,067 | A | 4/1986 | Mayer et al. | |
| 4,585,967 | A | 4/1986 | Mayer et al. | |
| 4,889,199 | A * | 12/1989 | Lee | E21B 21/003 175/317 |
| 5,197,547 | A | 3/1993 | Morgan | |
| 5,207,272 | A | 5/1993 | Pringle et al. | |
| 5,295,541 | A | 3/1994 | Ng et al. | |
| 5,370,183 | A | 12/1994 | Ellis et al. | |
| 5,437,340 | A | 8/1995 | Lee et al. | |
| 5,507,343 | A | 4/1996 | Carlton | |
| 5,613,560 | A | 3/1997 | Jelinski et al. | |
| 6,065,550 | A | 5/2000 | Gardes | |
| 6,209,663 | B1 | 4/2001 | Hosie | |
| 6,267,186 | B1 | 7/2001 | Hayatdavoudi | |
| 6,367,566 | B1 | 4/2002 | Hill | |
| 6,464,006 | B2 | 10/2002 | Womble | |
| 6,732,804 | B2 | 5/2004 | Hosie | |
| 7,017,670 | B2 | 3/2006 | Hazel | |
| 7,036,602 | B2 | 5/2006 | Turley et al. | |
| 7,048,067 | B1 | 5/2006 | Cook | |
| 7,090,036 | B2 | 8/2006 | de Boer | |
| 7,093,662 | B2 | 8/2006 | de Boer | |
| 7,156,182 | B2 | 1/2007 | Lynde et al. | |
| 8,733,458 | B2 | 5/2014 | Gambier et al. | |
| 9,279,307 | B2 | 3/2016 | Williamson | |
| 10,081,998 | B2 | 9/2018 | Tunget | |
| 10,370,943 | B2 | 8/2019 | El Nekhily et al. | |
| 10,408,013 | B2 | 9/2019 | Al-Mumen et al. | |
| 10,648,278 | B2 | 5/2020 | Al-Mumen et al. | |
| 10,662,728 | B2 | 5/2020 | Hajji et al. | |
| 10,669,798 | B2 | 6/2020 | Al-Qasim et al. | |
| 10,815,751 | B2 | 10/2020 | Al-Mumen et al. | |
| 11,149,510 | B1 * | 10/2021 | Al-Abdulrahman | E21B 23/00 |
| 2004/0079534 | A1 | 4/2004 | Harrall | |
| 2006/0196678 | A1 | 9/2006 | Connell | |
| 2008/0156479 | A1 | 7/2008 | Cassidy et al. | |
| 2009/0146442 | A1 | 6/2009 | Kelso | |
| 2009/0183884 | A1 | 7/2009 | Hansen | |
| 2009/0229835 | A1 | 9/2009 | Filippov | |
| 2010/0167961 | A1 | 7/2010 | Creasey | |
| 2010/0263856 | A1 | 10/2010 | Lynde et al. | |
| 2010/0300704 | A1 | 12/2010 | Sweeney et al. | |
| 2011/0042082 | A1 * | 2/2011 | Schultz | E21B 33/14 166/270 |
| 2011/0067890 | A1 * | 3/2011 | Themig | E21B 33/124 166/185 |
| 2011/0079390 | A1 * | 4/2011 | Themig | E21B 33/124 166/127 |
| 2011/0272164 | A1 | 11/2011 | Suijaatmadja | |
| 2012/0097391 | A1 | 4/2012 | Whiddon | |
| 2012/0175108 | A1 | 7/2012 | Foubister | |
| 2012/0292030 | A1 * | 11/2012 | Xu | E21B 34/14 166/308.1 |
| 2012/0325466 | A1 * | 12/2012 | Themig | E21B 34/06 166/185 |
| 2013/0126164 | A1 * | 5/2013 | Sweatman | C09K 8/467 166/282 |
| 2014/0034308 | A1 * | 2/2014 | Holderman | E21B 43/12 166/279 |
| 2014/0083702 | A1 | 3/2014 | Godfrey et al. | |
| 2014/0090846 | A1 | 4/2014 | Deutch | |
| 2015/0013972 | A1 * | 1/2015 | Al-Rabeh | E21B 47/11 166/250.12 |
| 2015/0292305 | A1 | 10/2015 | Galloway | |
| 2015/0308207 | A1 | 10/2015 | Mccormick | |
| 2016/0138361 | A1 | 5/2016 | Clemens | |
| 2016/0251933 | A1 | 9/2016 | Gharesi | |
| 2016/0362959 | A1 | 12/2016 | Zhou | |
| 2017/0044864 | A1 | 2/2017 | Sabins et al. | |
| 2017/0321522 | A1 | 11/2017 | Al-Hajri | |
| 2019/0032447 | A1 * | 1/2019 | Wakefield | E21B 43/26 |
| 2019/0368290 | A1 | 12/2019 | Vick, Jr. et al. | |
| 2020/0011156 | A1 * | 1/2020 | Hajji | E21B 27/02 |
| 2021/0277733 | A1 * | 9/2021 | Ssafwany | E21B 34/142 |
| 2022/0235619 | A1 * | 7/2022 | Nafa | E21B 23/01 |

FOREIGN PATENT DOCUMENTS

| | | |
|---|---|---|
| CN | 102493782 | 6/2012 |
| EP | 0418057 | 3/1991 |
| GB | 2311312 | 9/1997 |
| WO | WO 1999045232 | 9/1999 |
| WO | WO 2015088553 | 6/2015 |

OTHER PUBLICATIONS

U.S. Appl. No. 17/643,340, Al-Obaidi et al., filed Dec. 8, 2021.

Abedel-Aal et al., "Chapter 1: Oil and Gas, From Formation to Production," Taylor & Francis, Jul. 3, 2003, 42 pages.

Alhashimi, "Liner tie-backs stop casing leaks in Libyan completions—Oil & Gas Journal," Oil & Gas Journal, vol. 105 (1), Jan. 1, 2007, 12 pages.

Ansari et al., "Innovative Planning and Remediation Techniques for Restoring the Well Integrity by Curing High Annulus-B Pressure and Zonal Communication," International Petroleum Technology Conference, Nov. 2016, 25 pages.

Ansari et al., "Innovative Remediation Techniques for Restoring Well Integrity by Curing High Annulus-B Pressure and Zonal Communication," SPE Bergen One Day Seminar, Apr. 2017, 23 pages.

Jahn et. "Hydrocarbon Exploration and Production: 3.0 Drilling Engineering," Elsevier, Mar. 13, 1998, 16 pages.

Morris et al., "Innovative Remedial Cementing Solution Provides Annular Isolation in Duyong B-4 Petronas Carigali," Asia Pacific Drilling Technology Conference and Exhibition, Sep. 2004, 11 pages.

Schlumberger Oilfield Glossary Entry for "Crossflow" available on or before Nov. 8, 2018, via www.glossary.oilfield.slb.com, 1 page.

Sklet, "Safety barriers on oil and gas platforms: Means to prevent hydrocarbon releases" Thesis for the degree of doktor ingenior, Norwegian University of Science and Technology, Department of Production and Quality Engineering, Dec. 2005, 182 pages.

Weatherford International, "PCR Cement Retainer," brochure, 2007, 2 pages.

* cited by examiner

ACID-INTEGRATED DRILL PIPE BARS TO RELEASE STUCK PIPE

TECHNICAL FIELD

This disclosure relates to wellbore operations, for example, operations related to tubulars disposed within wellbores.

BACKGROUND

Wellbore operations include forming wellbores in a subterranean zone or producing hydrocarbons through wellbores formed in subterranean zones or both. A subterranean zone is a formation or a portion of a formation or multiple formations. In wellbore operations, a tubular (an elongated, hollow tube or pipe) is positioned inside the wellbore, and can be left in place or rotated or moved vertically (uphole or downhole). Sometimes, the subterranean zone in which the wellbore is formed or the wellbore operations cause the tubular to get stuck in the wellbore. A stuck tubular (or stuck pipe) is one that cannot be retrieved from the wellbore because, for example, a portion of the formation is projecting into the wellbore, thereby preventing the tubular from being pulled out of the wellbore.

SUMMARY

This disclosure describes technologies relating to acid-integrated drill pipe bars to release stuck pipe.

Certain aspects of the subject matter described here can be implemented as a method to release stuck pipe. It is determined that a tubular disposed within a wellbore is stuck. A portion of the tubular includes an annular compartment carrying acid which, upon contacting a formation in which the wellbore is formed, is configured to loosen the formation. The portion of the tubular includes a ball seat to receive a ball from a surface of the wellbore and multiple ports formed in a wall of the portion of the tubular that includes the annular compartment. Each of the multiple ports is configured to switch between an open position and a closed position. In the open position, the multiple ports permit fluid flow from the annular compartment to the formation. In the closed position, the multiple ports prevent fluid flow from the annular compartment to the formation. The multiple ports are in the closed position. In response to determining that the tubular within the wellbore is stuck, a ball is dropped from the surface into the wellbore. The ball seat receives the ball. After the ball seat receives the ball, the tubular is pressurized. Pressurizing the tubular causes the multiple ports to switch from the closed position to the open position causing the acid in the annular compartment to flow onto the formation.

An aspect combinable with any other aspect includes the following features.

The ball is a first ball. From the surface, multiple second balls are dropped into the wellbore. The number of second balls equals the number of ports. The number of second balls seal the respective ports. After dropping the multiple second balls, the tubular is pressurized. The pressurizing causes the multiple ports to switch from the open position to the closed position.

An aspect combinable with any other aspect includes the following features.

The multiple second balls are dropped one after another.

An aspect combinable with any other aspect includes the following features.

Before switching the multiple ports from the open position to the closed position, a duration is spent waiting after the acid in the annular compartment has flowed onto the formation. The duration is sufficient for the acid to loosen a portion of the formation where the tubular is stuck.

An aspect combinable with any other aspect includes the following features.

The portion of the tubular includes a ball catcher platform positioned within the portion of the tubular including the annular compartment downhole of the ball seat. In response to pressurizing the tubular after dropping the multiple second balls, the first ball and the multiple second balls are received on the ball catcher platform.

An aspect combinable with any other aspect includes the following features. To pressurize the tubular, the tubular is made up with a top drive and run into the wellbore.

An aspect combinable with any other aspect includes the following features.

Before disposing the tubular within the wellbore, the tubular is formed by connecting the portion of the tubular that includes the annular compartment uphole of another portion of the tubular such that, when the multiple ports are in the open position, the acid in the annular compartment flows downhole into the wellbore onto the formation.

Certain aspects of the subject matter described here can be implemented as a wellbore tool assembly to release stuck pipe. The assembly includes a tubular that includes an outer wall, an inner wall and an annular compartment defined between the outer wall and the inner wall. A quantity of acid is carried within the annular compartment of the tubular. Multiple ports are formed in the tubular. Each port fluidically connects an inner volume of the tubular with a volume outside the tubular through the annular compartment. The assembly includes a ball seat disposed within the tubular. The ball seat is configured to receive a ball dropped into the tubular. The multiple ports are configured to switch between an open position and a closed position. When in the open position, the multiple ports permit flow of the acid from the annular compartment to the formation. When in the closed position, the multiple ports prevent fluid flow from the annular compartment to the formation.

An aspect combinable with any other aspect includes the following features.

The ball seat is downhole of the multiple ports.

An aspect combinable with any other aspect includes the following features.

The assembly includes a first ball configured to be received on the ball seat and to form a seal with the ball seat in response to the tubular being pressurized after the first ball is received on the ball seat.

An aspect combinable with any other aspect includes the following features.

The assembly includes multiple second balls equal in number to a number of the multiple ports. Each second ball is configured to seal a respective port.

An aspect combinable with any other aspect includes the following features.

The assembly includes multiple second balls. A number of the second balls equals a number of the multiple ports. Each second ball is configured to seal a respective port.

An aspect combinable with any other aspect includes the following features.

The first ball and each of the second balls is dimensioned and the multiple ports and the ball seat are disposed within the tubular such that each of the second balls rests on the first ball when sealing the respective port.

An aspect combinable with any other aspect includes the following features.

The assembly includes a ball catcher platform positioned within the portion of the tubular including the annular compartment downhole of the ball seat. The ball catcher platform is configured to catch the first ball and the multiple second balls.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

A tubular (interchangeably referred to as "pipe" throughout this disclosure) that is disposed within a wellbore can have different portions of differing diameters. For example, a tubular portion with a larger diameter can be downhole of another tubular portion of comparatively smaller diameter. The weight of the formation can apply a force that forces a portion of the formation into the wellbore uphole of the larger diameter tubular portion. In such situations, the portion of the formation that extends into the wellbore can prevent vertical uphole movement of the entire tubular. Consequently, the tubular is stuck within the wellbore at a stuck point which is an intersection between the larger diameter tubular portion and the comparatively smaller diameter tubular portion. In some instances, the tubular can get stuck within the wellbore due to improper key seating, improper mud control, excessive overbalance, cuttings accumulation, cuttings or sand avalanche, shale cavings, balling up, or for other reasons. A stuck pipe contributes to nonproductive time in drilling operations for oil and gas.

This disclosure describes forming tubulars, for example, drilling assembly tubulars, with tubular portions that carry acid which, when released onto the formation, loosen the formation. As described below, when the tubular is stuck at a depth within the wellbore, a tubular portion that carries the acid and is uphole of that depth can be activated to release the acid onto the formation adjacent to the stuck point. By doing so, the stuck pipe can be released.

By implementing the techniques described in this disclosure, stuck pipe incidents can be mitigated in real time or without needing to introduce complex tools or tool assemblies. In this manner, nonproductive time during wellbore operations such as drilling operations can be minimized or eliminated. Implementing the techniques described in this disclosure can eliminate extra time spent on mixing the acid, which can provide a quick and effective solution in case a stuck pipe event is encountered.

Figure 1:
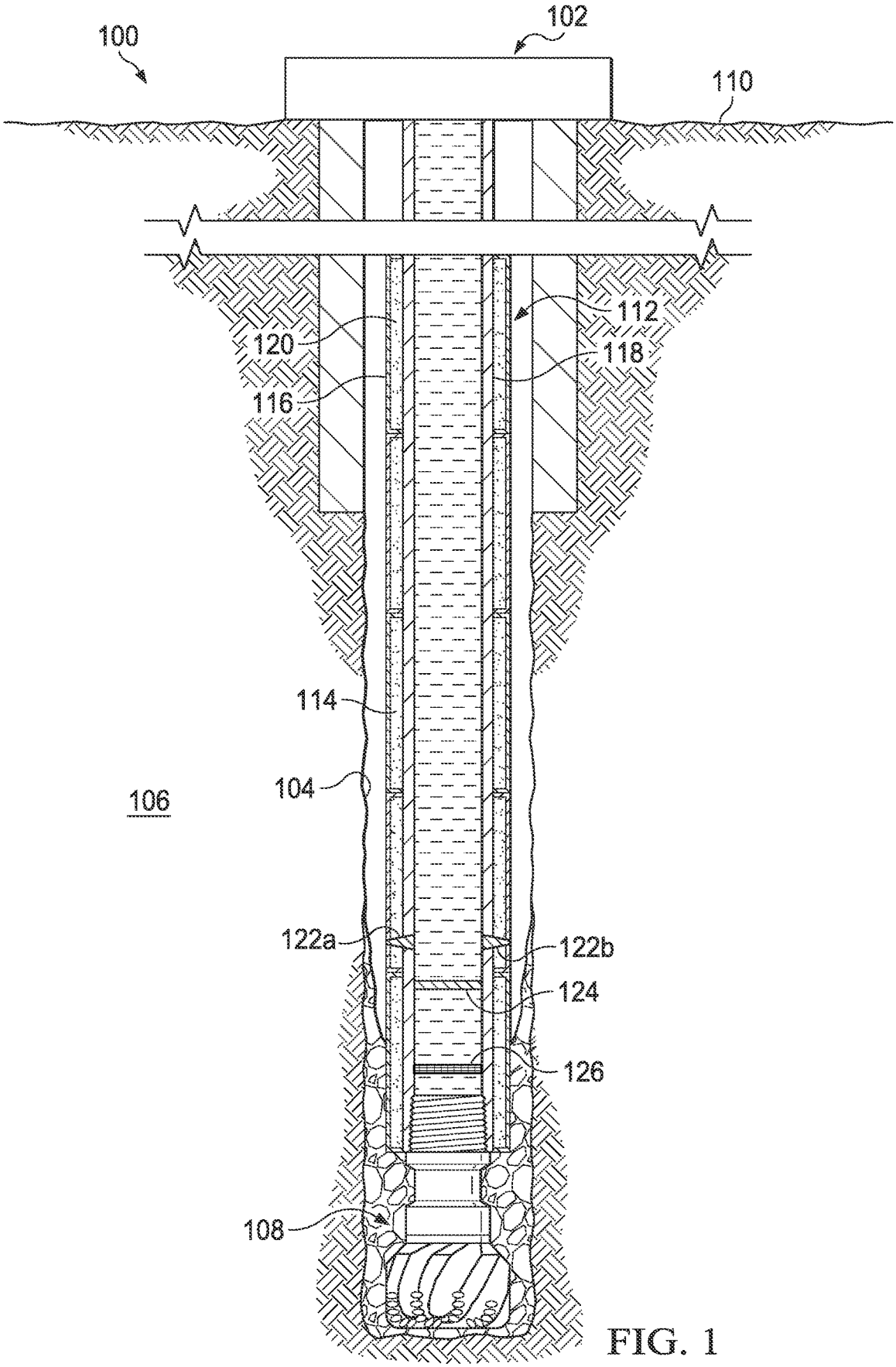
FIG. 1 is a schematic diagram of an example of a wellbore tool assembly to release a stuck pipe.

FIG. 1 is a schematic diagram of an example of a wellbore tool assembly 100 to release a stuck pipe 102. In some examples, the stuck pipe 102 is a tubular that is part of a wellbore drilling assembly used to drill a wellbore 104 in a subterranean zone 106. As shown in FIG. 1, the tubular 102 is stuck within the wellbore 104 at a stuck point 108. This means that the tubular 102 is trapped within the wellbore 104 at the stuck 108 and is unable to move downward through the subterranean zone 106 or upward to a surface 110 or both.

In anticipation of the tubular 102 being stuck in the wellbore 104, the tubular 102 is formed with one or more tubular portions (for example, a first tubular portion 112), each of which carries acid 114 which, upon contacting the formation 106 at the stuck point 108, can corrode and loosen the formation 106 at the stuck point 108. In some implementations, the tubular portion 112 includes an outer wall 116 and an inner wall 118. The tubular portion 112 defines an annular compartment 120 between the outer wall 116 and the inner wall 118 within which a quantity of the acid 114 is carried. The inner wall 118 and the outer wall 116, each have a thickness that gives the tubular portion 112 sufficient strength to operate as a component of the tubular 102. In some implementations, the inner wall 118 and the outer wall 116 are spaced apart by a distance that provides sufficient volume to form the annular compartment 120 carry the quantity of the acid 114. The quantity of the acid 114 can be sufficient to corrode and loosen the formation 106. In some examples, each acid compartment can contain+/−0.25 bbl of acid for 4000 feet of drill pipe, which represents a maximum total capacity of 60 bbls.

In some implementations, the tubular portion 112 is made of a material that is non-corrosive or otherwise unaffected by the acidic nature of the acid 114 in the annular compartment 120. Alternatively or in addition, a surface of the inner wall 118 and a surface of the outer wall 116 that contact the acid 114 can be coated with a material that protects the inner wall 118 and the outer wall 116 from corrosion or other wear caused by the acid 114. Any acid resistant coating can be used.

In some implementations, the tubular portion 112 can include multiple ports (for example, port 122*a*, port 122*b*) through which acid in the annular compartment 120 can be released onto the formation 106. The tubular portion 112 has a cylindrical cross-section and defines an inner volume bounded by the inner wall 118. The tubular portion 112 is disposed within a volume of the wellbore 104 with the outer wall 116 serving as a boundary. Each of the multiple ports fluidically connect the inner volume of the tubular portion 112 with the volume outside the tubular portion 112 through the annular compartment 120. As described below, the multiple ports can be opened from within the tubular portion 112, i.e., from within the inner volume of the tubular portion 112, thereby allowing the acid 114 in the annular compartment 120 to flow to the volume outside the tubular portion 112 and on to the formation 106, specifically at the stuck point 108. In this manner, the ports can be opened from inside the drill pipe to allow acid to flow outside the drill pipe.

In some implementations, a ball seat 124 is disposed within the tubular portion 112. The ball seat 124 is configured to receive a ball (described later) dropped into the tubular portion 112, specifically into the tubular 102. The multiple ports are configured to switch between an open position and a closed position. When in the open position, the multiple ports permit flow of the acid 114 from the annular compartment 120 into the formation 106. When in the closed position, the multiple ports prevent fluid flow from the annular compartment 120 to the formation 106. When the tubular portion 112 is disposed within the wellbore 106, the ball seat 124 is downhole of the multiple ports for reasons described later. In some implementations, the tubular portion 112 includes a ball capturing platform 126. When the tubular portion 112 is disposed within the wellbore 106, the ball capturing platform 126 is downhole of the ball seat 124 for reasons described later.

Figure 2:
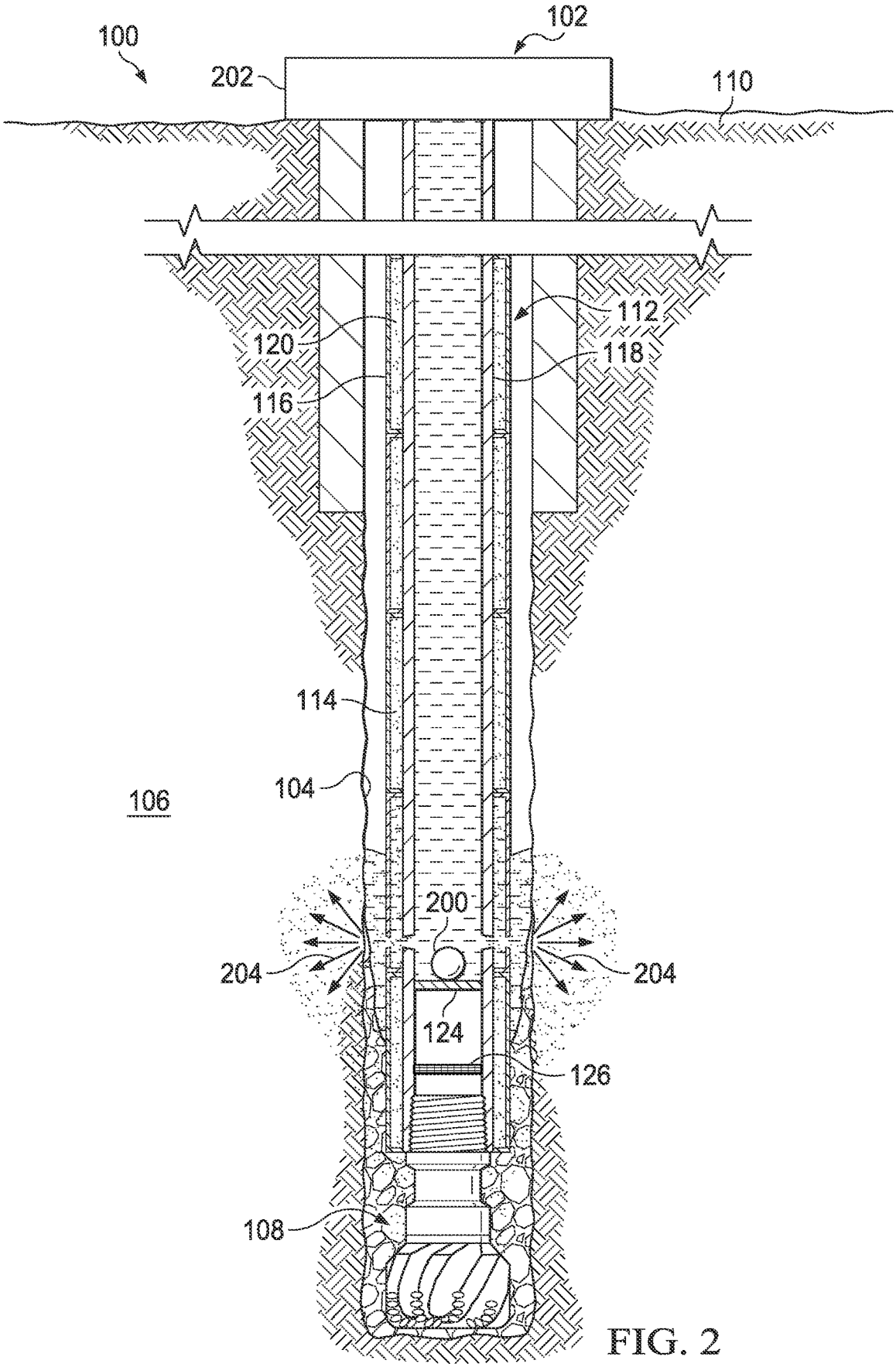
FIG. 2 is a schematic diagram of the wellbore tool assembly of FIG. 1 releasing acid onto the formation.

FIG. 2 is a schematic diagram of the wellbore tool assembly of FIG. 1 releasing acid 114 onto the formation 106. The wellbore tool assembly 100 is operated to release the acid 114 on to the formation 106 upon determining that the tubular 102 disposed within the wellbore 104 is stuck. When the tubular portion 112 is connected to the tubular 102 for use within the wellbore 104, the multiple ports are in the closed position. The ports act as a piston, which is a moving disk enclosed in a cylinder. The port has piston rings. The disk moves inside the cylinder as a liquid under expansion mode. The piston aids in the transformation of heat energy into mechanical work. In response to determining that the tubular 102 within the wellbore 104 is stuck, an operator drops, from the surface and into the wellbore 104, a first ball 200. The first ball 200 travels downhole end is received by the ball seat 124. The ball seat 124 includes an opening (not shown) that receives the first ball 200. The first ball 200 closes the opening and forms a seal with the ball seat 124.

After the ball seat 124 receives the first ball 200 and forms the sealing, the tubular 102 is pressurized. In some implementations, before pressurizing, the tubular 102 is made up with a top drive 202 and run into the wellbore 104. To pressurize the tubular 102, a fluid is flowed through the tubular 102 from the surface at a fluid pressure, for example, 10 strokes per minute (SPM). As the fluid, for example, water or other fluid, is flowed through the tubular 102, pressure builds within the tubular portion 112. The operator continuously measures this pressure using a pressure sensor either at the surface or at a downhole location. As the pressure builds, the multiple ports are sheared and the multiple ports switch from the closed position to the open position. In the open position, the fluid being flowed through the tubular 102 can enter the annular compartment 120 and build pressure in the annular compartment 120. As the pressure continues to build, the ports permit access from the annular compartment 120 the volume outside the tubular 102. At this point, the pressure drops indicating that the multiple ports have opened. Fluid flow from the surface can be stopped, and all the fluid including the acid 114 in the acid compartment 120 flows onto the formation 104. Because the multiple ports are uphole of the stuck point 108, the acid 114 contacts the formation 106 at the stuck point 108, thereby corroding and loosening the formation 106 at the start point 108.

Figure 3:
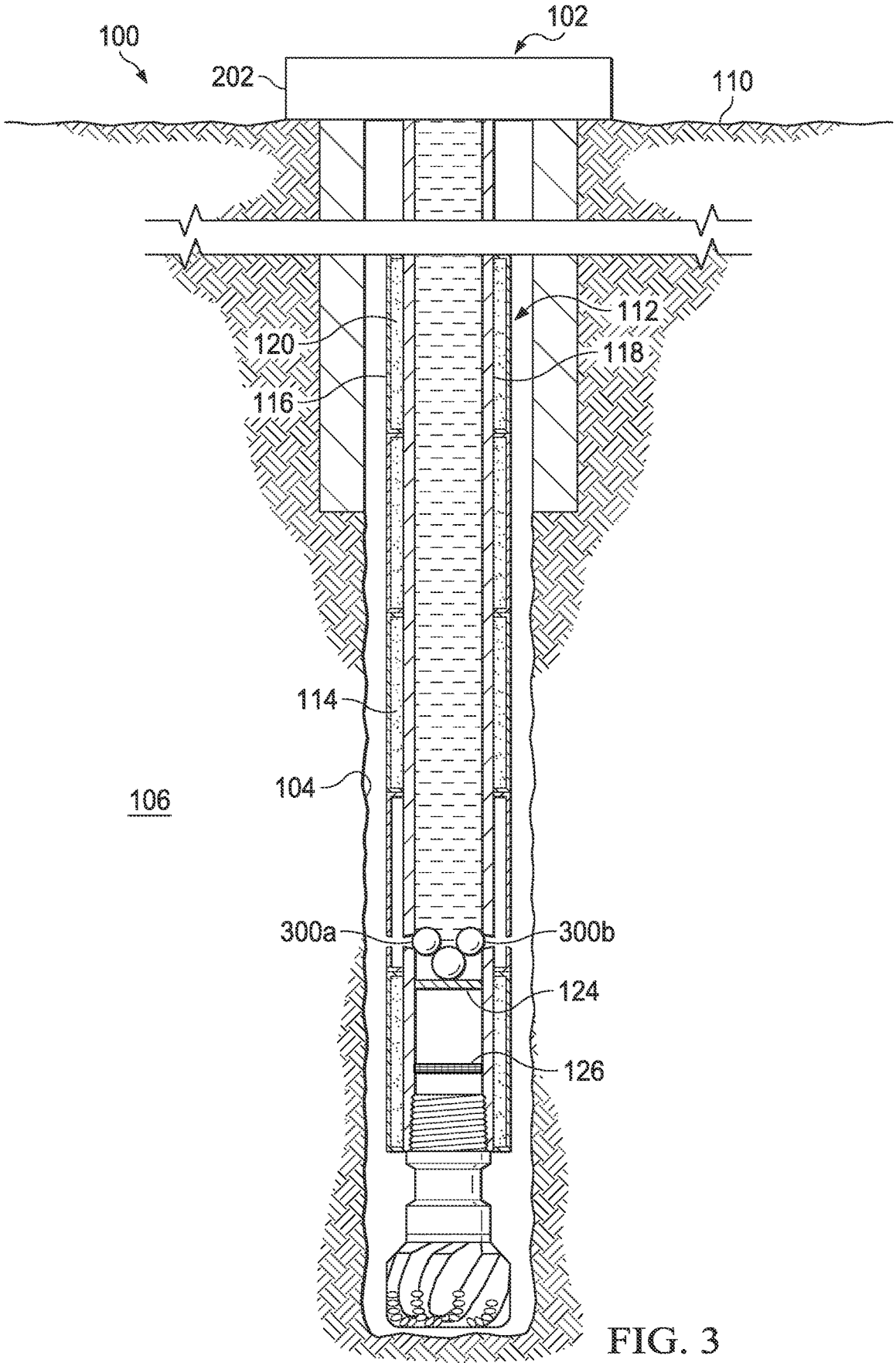
FIG. 3 is a schematic diagram of the wellbore tool assembly of FIG. 1.

FIG. 3 is a schematic diagram of the wellbore tool assembly 102 of FIG. 1. After releasing the acid 114 from the annular compartment 120 onto the stuck point 108 of the formation 106 within the wellbore 104, the operator waits for a duration sufficient for the acid to corrode and loosen a portion of the formation 106 where the tubular 102 is stuck. Once the portion of the formation has loosened, the operator can rotate or move the tubular 102 upward or downward. Before doing so, the operator can close the multiple ports and switch the ports from the open position to the closed position.

To do so, the operator drops multiple second balls (for example, second ball 300*a*, second ball 300*b*) from the surface and into the tubular 102. A number of second balls includes a number of ports because each second ball closes a respective port. In some implementations, the operator drops the multiple second balls one after another, i.e., with a lag time (for example, 15 seconds plus or −5 seconds). In other words, the operator does not drop the multiple second ball simultaneously to prevent that the multiple second balls from getting stuck within the tubular 102. In some implementations, the first ball 200 and each of the second balls is dimensioned, and the multiple ports and the ball seat 124 are spaced apart within the tubular portion 112 such that each of the second balls rests on the first ball and seals a respective port. With the second balls in these positions, fluid is once again flowed through the tubular 102 from the surface and pressure within the tubular 102 is measured. An increase in the pressure indicates that the second balls have completely sealed the multiple ports, thereby switching the ports to the closed position.

Figure 4:
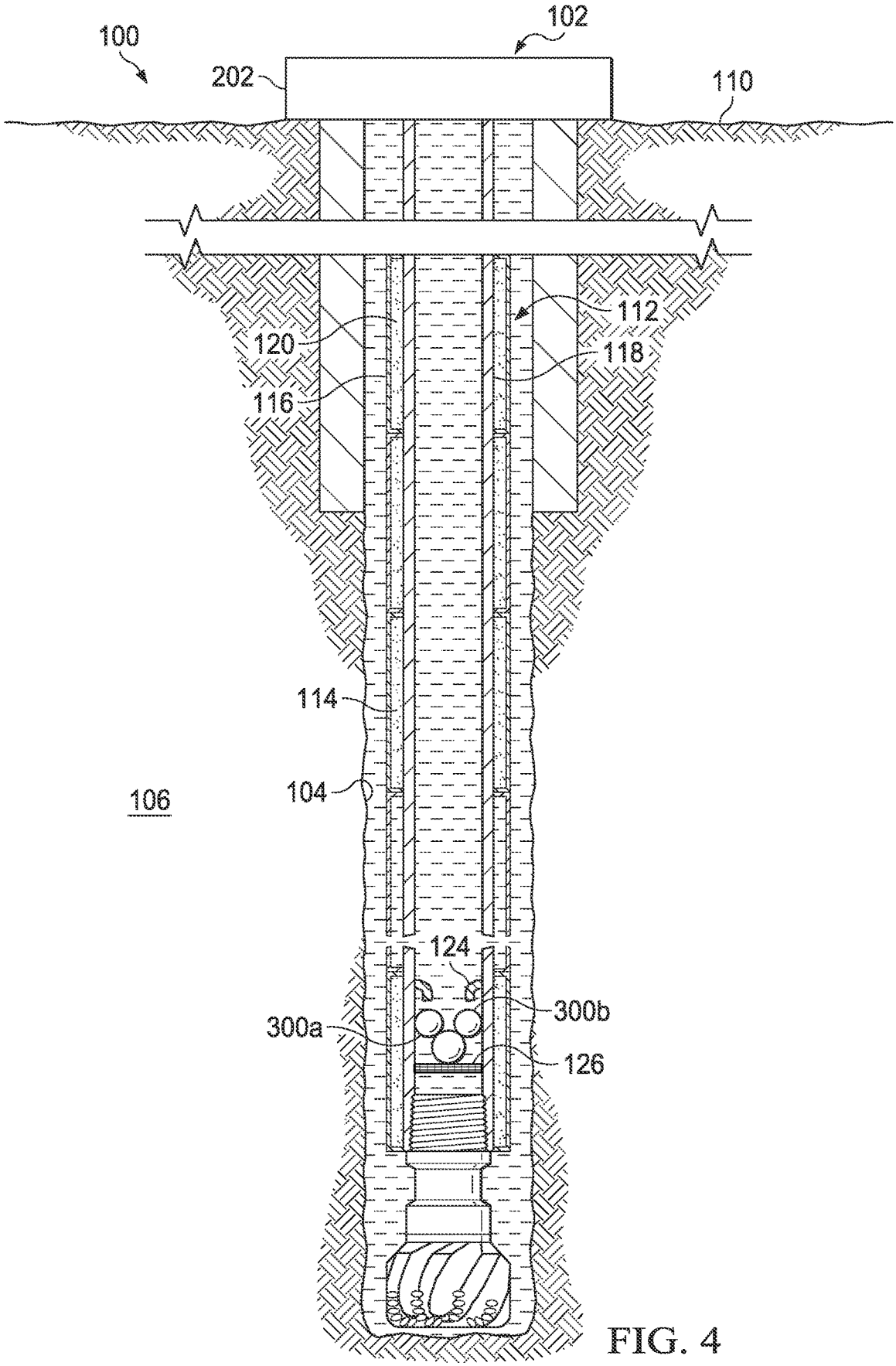
FIG. 4 is a schematic diagram of the wellbore tool assembly of FIG. 1.

FIG. 4 is a schematic diagram of the wellbore tubular assembly 100 of FIG. 1. As described earlier the ball catcher platform 126 is positioned within the tubular portion downhole of the ball seat 124. Once the multiple ports have been sealed as described earlier, pressure within the tubular 102 is increased causing the first ball 200 and the multiple second balls to drop downhole of the ball seat 124 and to be caught by the ball catcher platform 126. For example, the increase in pressure causes the balls to break the ball seat 124 and go further downhole into the ball catcher platform 126. The ball catcher platform 126 has a mesh that allows the platform to catch the ball but to allow the fluid to flow through further downhole. With the tubular 102 now unstuck, the operator can resume the wellbore operations.

Figure 5:
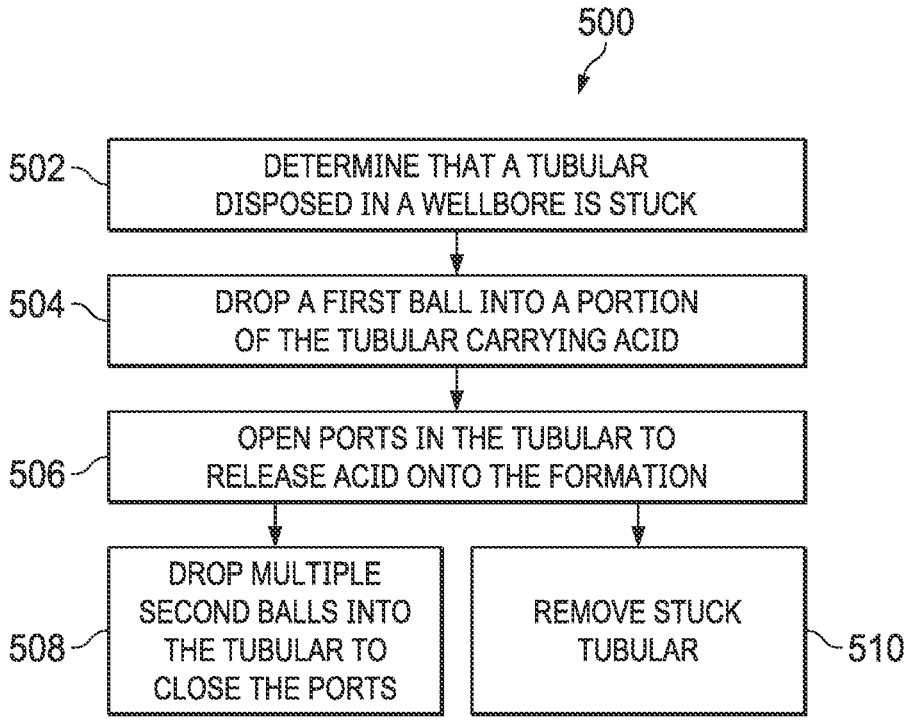
FIG. 5 is a flowchart of an example of a method of operating the wellbore tool assembly of FIG. 1.

FIG. 5 is a flowchart of an example of a method 500 of operating the tubular of FIG. 1. At least some of the steps of the method 500 can be performed by a wellbore operator 502, the operator determines that the tubular disposed in the wellbore is stuck. At 504, the operator drops a first ball into a portion of the tubular which carries acid in an annular compartment as described earlier with reference to FIG. 1. At 506, the operator opens the ports in the tubular by pressurizing the tubular to release acid on to the formation. At 508, the operator drops multiple second balls into the tubular and pressurizes the tubular to close the ports. Alternatively or in addition, at 510, the operator can remove the previously stuck tubular.

Thus, particular implementations of the subject matter have been described. Other implementations are within the scope of the following claims.

The invention claimed is:

1. A method to release stuck pipe, the method comprising:

determining that a tubular disposed within a wellbore is stuck, wherein a portion of the tubular includes an annular compartment carrying acid which, upon contacting a formation in which the wellbore is formed, is configured to loosen the formation, wherein the portion of the tubular comprises:

a ball seat to receive a ball from a surface of the wellbore, and a plurality of ports formed in a wall of the portion of the tubular that includes the annular compartment, wherein each of the plurality of ports is configured to switch between an open position and a closed position, wherein, in the open position, the plurality of ports permit fluid flow from the annular compartment to the formation, and in the closed position, the plurality of ports prevent fluid flow from the annular compartment to the formation, wherein the plurality of ports are in the closed position;

in response to determining that the tubular within the wellbore is stuck, dropping, from the surface and into the wellbore, the ball, wherein the ball seat receives the ball; and after the ball seat receives the ball, pressurizing the tubular, wherein the pressurizing causes switching the plurality of ports from the closed position to the open position causing the acid in the annular compartment to flow onto the formation.

2. The method of claim 1, wherein the ball is a first ball, wherein the method further comprises:

dropping, from the surface and into the wellbore, a plurality of second balls equal in number to a number of the plurality of ports, wherein the plurality of second balls seal the respective plurality of ports; and after dropping the plurality of second balls, pressurizing the tubular, wherein the pressurizing causes the plurality of ports to switch from the open position to the closed position.

3. The method of claim 2, wherein dropping the plurality of second balls comprises dropping the plurality of second balls one after another.

4. The method of claim 2, further comprising, before switching the plurality of ports from the open position to the closed position, waiting for a duration after the acid in the annular compartment has flowed onto the formation, wherein the duration is sufficient for the acid to loosen a portion of the formation where the tubular is stuck.

5. The method of claim 2, wherein the portion of the tubular further comprises a ball catcher platform positioned within the portion of the tubular including the annular compartment downhole of the ball seat, wherein the method further comprises, in response to pressurizing the tubular after dropping the plurality of second balls, receiving the first ball and the plurality of second balls on the ball catcher platform.

6. The method of claim 1, wherein pressurizing the tubular comprises:

making up the tubular with a top drive; and running the made up tubular into the wellbore.

7. The method of claim 1, further comprising, before disposing the tubular within the wellbore, forming the tubular by connecting the portion of the tubular that includes the annular compartment uphole of another portion of the tubular such that, when the plurality of ports are in the open position, the acid carried in the annular compartment flows downhole in the wellbore onto the formation.

8. A wellbore tool assembly to release stuck pipe, the assembly comprising:

a tubular comprising:

an outer wall, an inner wall, an annular compartment defined between the outer wall and the inner wall;

a quantity of acid carried within the annular compartment of the tubular, a plurality of ports formed in the tubular, each port fluidically connecting an inner volume of the tubular with a volume outside the tubular through the annular compartment;

a ball seat disposed within the tubular, the ball seat configured to receive a first ball dropped into the tubular, wherein the plurality of ports are configured to switch between an open position and a closed position, wherein, when in the open position, the plurality of ports permit flow of the acid from the annular compartment to the formation, and, when in the closed position, the plurality of ports prevent fluid flow from the annular compartment to the formation;

the first ball configured to be received on the ball seat and to form a seal with the ball seat in response to the tubular being pressurized after the first ball is received on the ball seat; and a plurality of second balls equal in number to a number of the plurality of ports, each second ball configured to seal a respective port.

9. The assembly of claim 8, wherein the ball seat is downhole of the plurality of ports.

10. The assembly of claim 8, wherein the first ball and each of the second balls is dimensioned, and the plurality of ports and the ball seat are disposed within the tubular such that each of the second balls rests on the first ball when sealing the respective port.

11. The assembly of claim 10, further comprising a ball catcher platform positioned within the portion of the tubular including the annular compartment downhole of the ball seat, the ball catcher platform configured to catch the first ball and the plurality of second balls.

* * * * *